US006666202B1

(12) United States Patent
Darlington

(10) Patent No.: US 6,666,202 B1
(45) Date of Patent: Dec. 23, 2003

(54) SINGLE-CAM COMPOUND ARCHERY BOW

(76) Inventor: Rex F. Darlington, 6828 Maple Acres Dr., Whittemore, MI (US) 48770

( * ) Notice: Subject to any disclaimer, the term of this patent is extended or adjusted under 35 U.S.C. 154(b) by 0 days.

(21) Appl. No.: 10/014,749

(22) Filed: Oct. 26, 2001

Related U.S. Application Data

(60) Provisional application No. 60/246,248, filed on Nov. 6, 2000.

(51) Int. Cl.[7] ..... F41B 5/10
(52) U.S. Cl. ..... 124/25.6; 124/900
(58) Field of Search ..... 124/25.6, 900

(56) References Cited

U.S. PATENT DOCUMENTS

| | | | |
|---|---|---|---|
| 4,401,097 | A | 8/1983 | Simonds |
| 4,438,753 | A | 3/1984 | Simonds |
| 4,519,374 | A | 5/1985 | Miller |
| 4,774,927 | A | 10/1988 | Larson |
| 4,838,236 | A | 6/1989 | Kudlacek |
| 4,926,832 | A | 5/1990 | Darlington |
| 4,926,833 | A | 5/1990 | Darlington |
| 4,967,721 | A | 11/1990 | Larson |
| 4,976,250 | A | 12/1990 | Jeffrey |
| 4,986,250 | A | 1/1991 | Darlington |
| 5,092,309 | A | 3/1992 | Beaton |
| 5,301,651 | A | 4/1994 | LaBorde et al. |
| 5,368,006 | A | 11/1994 | McPherson |
| 5,433,792 | A | 7/1995 | Darlington |
| 5,505,185 | A | 4/1996 | Miller |
| 5,649,522 | A | 7/1997 | Troncoso |
| 5,678,529 | A | 10/1997 | Larson |
| 5,782,229 | A | 7/1998 | Evans et al. |
| 5,791,322 | A | 8/1998 | McPherson |
| 5,934,265 | A | 8/1999 | Darlington |
| 5,975,067 | A | 11/1999 | Strother |
| 6,082,347 | A | 7/2000 | Darlington |
| 6,112,732 | A | 9/2000 | Larson |

FOREIGN PATENT DOCUMENTS

| | | |
|---|---|---|
| CA | 2183305 | 2/1997 |

OTHER PUBLICATIONS

Mulloney, "One Step Beyond the Compound?" Archery World, Sep. 1976.
"Graham Take–Down Dynabo," Archery World, Jun./Jul. 1980.
Patent application of Larry D. Miller for "Archery Bow Assembly," date and Ser. No. unknown.
Alpine Archery Bow Manual, 1989.
"Instruction Manual—York Thunderbolt DynaBo," York Archery (date unknown).
"M–10 Dynabo Draw Chart," Martin Archery, Inc. (date unknown).
M–10 Cheetah DynaBo Owner's Manual, Martin Archery (date unknown).

*Primary Examiner*—John A. Ricci
(74) *Attorney, Agent, or Firm*—Reising, Ethington, Barnes, Kisselle, P.C.

(57) ABSTRACT

A single-cam compound archery bow includes a bow handle having projecting limbs. A control wheel is mounted for rotation about an axis at an end of one of the limbs, and has a single peripheral groove that extends around such axis. A power cam is mounted for rotation at an end of the other limb. A bow cable arrangement includes a first cable segment anchored at one end to the one limb and at a second end to the power cam. A second cable segment is anchored to the control wheel and extends to the power cam. A third cable segment is anchored to the control wheel and extends to the power cam. The third cable segment includes a nock point that, when drawn away from the handle, unwraps the third cable segment from the control wheel groove, and wraps the second cable segment into the control wheel groove as the third cable segment is unwrapped from that groove. Drawing of the nock point away from the handle also wraps the first cable segment onto the power cam so as to draw the limbs together. The single peripheral groove in the control wheel lies in a plane perpendicular to the axis of rotation of the control wheel.

21 Claims, 6 Drawing Sheets

SINGLE-CAM COMPOUND ARCHERY BOW

This application claims priority from application Ser. No. 60/246,248 filed Nov. 6, 2000.

The present invention is directed to compound archery bows, and more particularly to a so-called single-cam compound archery bow having a power let-off cam mounted on the end of only one of the bow limbs.

BACKGROUND OF THE INVENTION

Compound archery bows typically are of the so-called dual-cam design, originated in U.S. Pat. No. 3,486,495. Bows of this type typically comprise a bow handle having limbs mounted on and extending from opposed ends of the handle. Power let-off cams are rotatably mounted on the free ends of the bow limbs, and are interconnected by one or more cable sections including a draw string section. As the bow draw string is drawn away from the handle, draw force initially increases as the limbs are drawn together and the cams rotate to a power let-off point, and thereafter the leverage increases and the draw force decreases as the cams rotate further but with little additional limb flexure. This so-called compound action allows full bow draw to be maintained at lesser force without fatigue to the archer. A problem inherent in dual-cam bows of this type lies in the fact that the cams must be closely matched and synchronized with each other in order to insure straight-line (or substantially straight-line) travel of the nock point on the bowstring, and the limbs must be closely balanced and evenly stressed as the string is drawn. Damage to or mismatch of the cams, mismatch or incorrect adjustment of the limbs, or stretching of the cable sections can cause loss of synchronization between the cams and uneven stressing of the limbs, resulting in less than optimum performance of the bow and erratic arrow flight.

In order to overcome the aforementioned deficiencies of dual-cam bows, it has heretofore been proposed to provide a compound bow that has a single power let-off cam disposed at the end of one bow limb, and a control pulley or wheel disposed at the end of the opposing limb over which the bowstring is trained. U.S. Pat. No. 5,505,185 discloses such a single-cam compound bow. A control cable cooperates with a power let-off cam and a control groove in the control wheel or a second let-out groove on the power cam to maintain the desired relationship or timing between bowstring let-out grooves in the control wheel and power cam. In this way, identical or substantially identical incremental bowstring cable travel to and from the bowstring let-out grooves is obtained, thereby yielding straight-line nock travel as the bowstring cable is drawn and released. A power cable extends from the power cam to the opposing bow limb for flexing the blow limbs uniformly as the bowstring is drawn, and for cooperating with the power cam to obtain the power let-off action that is characteristic of compound bows.

Although the single-cam compound bow disclosed in the noted patent addresses and overcomes many problems theretofore extant in the art, further improvements remain desirable. In particular, the noted patent does not disclose any means or technique for adjusting draw length of the bow. That is, the bow disclosed in the noted patent obtains straight-line nock travel for a given bow draw length for which the power cam and the control wheel or the second let-out groove of the power cam are designed. In order to change or adjust bowstring draw length, the power cam and/or the control wheel must be changed to accommodate the new desired draw length while maintaining synchronous timing between the cam and wheel. In a commercial single-cam compound bow of a different design, accommodation is made for changing the bowstring cable anchor point at the power let-off cam, and thereby changing the bowstring draw length. However, since the cams and wheels are optimized for only a single draw length, changing the bowstring anchor point inherently changes the path of nock travel as the bow is drawn and released, and consequently affects shootability of the bow.

U.S. Pat. 5,934,265 discloses a single-cam compound archery bow that includes a bow handle from which bow limbs project, a control wheel rotatably mounted on one end of one limb and a power cam rotatably mounted at an opposing end of the other limb. A power cable segment is anchored at one end to the one limb and at a second end to the power cam at a position to wrap into and unwrap from a power cable groove on the power cam. A bowstring cable segment is anchored to the control wheel and to the power cam at positions to wrap into and unwrap from first and second bowstring let-out grooves on the control wheel and the power cam respectively. The bowstring cable segment has a nock point disposed between the spaced limb ends. A control cable segment is anchored at one end to the control wheel at a position to wrap into and unwrap from a control groove on the control wheel, and is anchored at an opposing end to the power cam. As the bowstring cable segment is drawn away from the handle, the bowstring cable segment unwraps equally from the control wheel and power cam, wraps the power cable segment into the power cable groove on the power cam so as to draw the bow limb ends together to a power let-off point at the power cable groove, and wraps the control cable segment into the control groove on the control wheel. Length of the power cable groove on the power cam, and position of the power let-off point on the power cam, are adjustable while maintaining a fixed separation between the power let-off point and the control cable anchor on the power cam, so that the nock point travels in a straight line as the bowstring cable section is drawn and released independent of adjusted length of the power cable groove and position of the power let-off point.

U.S. Pat. No. 5,934,265 also describes an embodiment in which the bowstring cable segment and the control cable segment form a continuous length that is trained around a pulley having a single groove that is concentric with the axis of pulley rotation. The cable is not anchored to the pulley. Such an arrangement does not provide desired control of nock point travel, control cable let-out or bow energy storage. U.S. Pat. No. 6,082,347 discloses a single-cam compound archery bow in which, in the preferred embodiments, provision is made at both the power cam and the control wheel for adjusting bowstring cable draw length. Furthermore, timing indicia are provided on both the power cam and the control wheel for selective registry with the control cable segment on the control wheel and the power cable segment on the power cam to fine-tune adjustment of nock point travel.

SUMMARY OF THE INVENTION

A single-cam compound archery bow in accordance with a first aspect of the present invention includes a bow handle having projecting limbs. A control wheel is mounted for rotation about an axis at an end of one of the limbs, and has a single peripheral groove that extends around such axis. A power cam is mounted for rotation at an end of the other limb. A bow cable arrangement includes a first cable segment anchored at one end to the one limb and at a second end to the power cam. A second cable segment is anchored to the control wheel and extends to the power cam. A third cable segment is anchored to the control wheel and extends to the power cam. The third cable segment includes a nock point that, when drawn away from the handle, unwraps the third cable segment from the control wheel groove, and wraps the second cable segment into the control wheel groove as the third cable segment is unwrapped from that groove. Drawing of the nock point away from the handle also wraps the first cable segment onto the power cam so as to draw the limbs together. The single peripheral groove in the control wheel preferably lies in a plane perpendicular to the axis of rotation of the control wheel.

A single-cam compound archery bow in accordance with a second aspect of the invention includes a bow handle having projecting limbs, a control wheel mounted on an end of one of the limbs for rotation about an axis, and a power cam rotatably mounted on an end of the other limb. The control wheel has a peripheral control wheel groove in a plane perpendicular to the axis of rotation of the control wheel. The power cam includes a bowstring groove and a power cable groove. A bow cable arrangement includes a power cable segment anchored at one end at the axis of rotation of the control wheel, and at a second end to the power cam at a position to wrap into and unwrap from the power cable groove. A bowstring cable segment is anchored at the control wheel at a position to wrap into and unwrap from the control wheel groove, and is anchored at the power cam at a position to wrap into and unwrap from the bowstring groove on the power cam. A control cable segment is anchored at the control wheel at a position to wrap into and unwrap from the control wheel groove, and is anchored at the power cam. As the bowstring cable segment is drawn away from the handle, the bowstring cable segment unwraps from the bowstring groove and the control wheel groove, the control cable segment wraps into the control wheel groove as the bowstring cable segment unwraps therefrom, and the power cable segment wraps into the power cable groove on the power cam to draw the limbs together. The control cable segment and the bowstring cable segment may comprise separate cable segments separately anchored at the control wheel, or may comprise a single length of bow cable anchored at the control wheel effectively to divide the cable length into separate control cable and bowstring cable segments. The peripheral groove on the control wheel may be either circular or non-circular, and may be either concentric with or non-concentric with the axis of rotation of the control wheel.

A control wheel for a single-cam compound archery bow in accordance with another aspect of the present invention includes a body for mounting on a bow limb to rotate about an axis, and a single peripheral groove surrounding the axis and lying in a plane perpendicular to the axis. The single peripheral groove includes a gap, and one or more anchors are disposed radially inwardly of the gap for anchoring bow cable segments to wrap into and unwrap from portions of the groove on opposite sides of the gap. The peripheral groove may be either circular or non-circular, and may be either concentric with or non-concentric with the rotation axis. The anchor(s) may be such as to anchor separate cable segments to the control wheel, or to anchor a single length of cable to the control wheel while effectively dividing the length into separate cable segments.

BRIEF DESCRIPTION OF THE DRAWINGS

The invention, together with objects, features and advantages thereof, will be best understood from the following description, the appended claims and the accompanying drawings in which:

DETAILED DESCRIPTION OF PREFERRED EMBODIMENTS

The disclosures of above-noted U.S. Pat. Nos. 5,934,265 and 6,082,347 are incorporated herein by reference.

Figure 1:
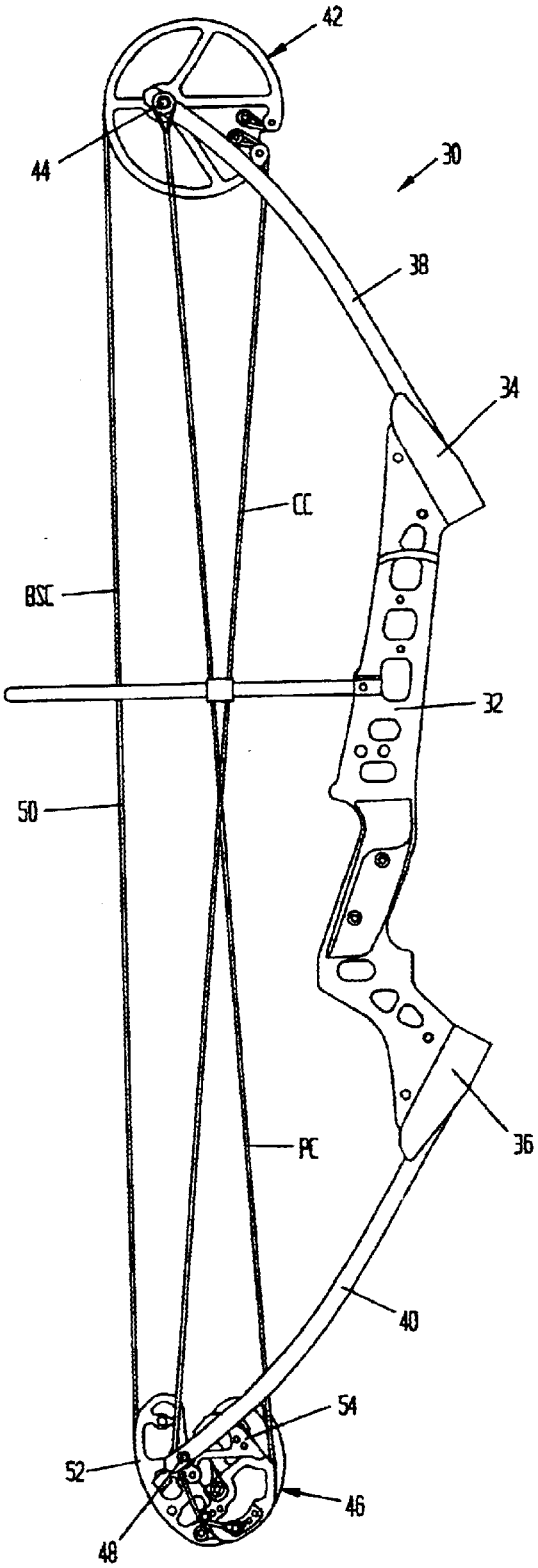
FIG. 1 is a side elevational view of a single-cam compound archery bow in accordance with one presently preferred embodiment of the invention.

FIG. 1 illustrates a single-cam compound archery bow 30 in accordance with one presently preferred embodiment of the invention as comprising a handle 32 of cast magnesium or other rigid unitary construction having spaced ends 34, 36 with flat limb-mounting surfaces at each end. A pair of flexible resilient limbs 38, 40 of fiber-reinforced resin or other suitable resilient construction are mounted on handle ends 34, 36 respectively, and project away from handle 32. A control wheel 42 is mounted on an axle 44 that extends laterally across the free end of bow limb 38, such that control wheel 42 is rotatably mounted within an open notch or bracket at the free end of limb 38. Likewise, a power cam 46 is mounted on an axle 48 that extends laterally across the free end of limb 40, such that power cam 46 is rotatably mounted within a notch or bracket at the free end of limb 40. Control wheel 42 and power cam 46 may be rotatable on axles 44,48, or the axles may be secured to the control wheel and/or power cam and rotatable on the limbs. The positions of control wheel 42 and power cam 46 may, of course, be reversed. A power cable PC has a split end that is anchored to limb 38 at axle 44, preferably although not necessarily on both sides of control wheel 42. Power cable PC extends across bow 30 to power cam 46, at which power cable PC is anchored. A control cable CC is anchored at one end to control wheel 42 and at an opposing end to power cam 46. Likewise, a bowstring cable BSC is anchored at opposing ends to control wheel 42 and power cam 46. A nock 50 is carried by bowstring cable BSC between control wheel 42 and power cam 46. Power cam 46 comprises a cam base 52 and a draw-length adjustment module 54 mounted thereon. Power cam 46 is similar to a cam illustrated in U.S. Pat No. 6,516,790 the disclosure of which is incorporated herein by reference for further discussion of the power cam assembly.

Figure 2:
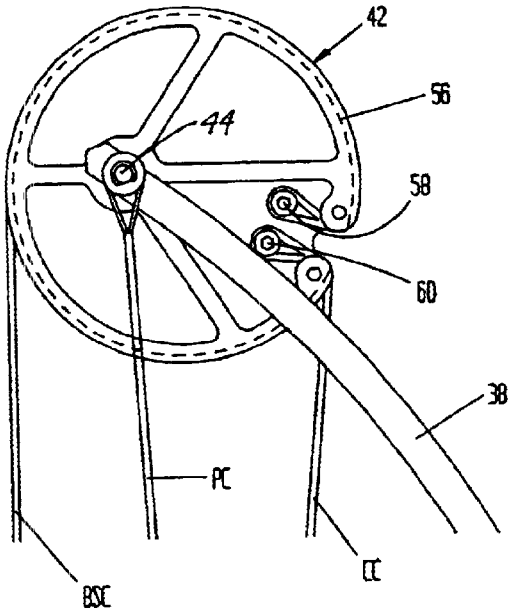
FIG. 2 is a fragmentary elevational view that features the control wheel or idler in the bow of FIG. 1.

As best seen in FIG. 2, control wheel 42 has a single circular peripheral groove 56 with a center or axis that is offset from the axis of axle 44. Peripheral groove 56 lies in a plane that is perpendicular to the axis of axle 44. Bowstring cable BSC extends clockwise around the periphery of groove 56 and is anchored to control wheel 42 at a post 58. Control cable CC extends counterclockwise through a small tangential portion of groove 56 (in the rest position of the bow and the orientation illustrated in FIGS. 1 and 2), and is anchored to control wheel 42 at a post 60. There is thus a gap in peripheral groove 56 through which cables BSC and CC extend to respective anchor posts 58, 60, which are mounted to the body of the control wheel radially inwardly of the gap. As a modification to the embodiment illustrated in FIG. 2, control cable CC and bowstring cable BSC may comprise a single length of cable that is suitably anchored to the control wheel. Thus, as bowstring cable BSC is drawn, the effective radius of groove 56 from axle 44 continuously changes. Both the bowstring cable and the control cable travel in groove 56. The bowstring cable is let out as the bow is drawn, and the control cable is taken up in the same groove. At some point, the control cable may enter a segment of the groove that was previously occupied by the bowstring cable in the rest position of the bow. The control wheel configuration illustrated in FIGS. 1 and 2 provides more control of the let-out of the bowstring while maintaining better control of travel of nock point 50 and making it easier to achieve more stored energy in the bow. Wrapping into and unwrapping from a single peripheral groove at the periphery of control wheel 42 also reduces bending stresses on the axle that would otherwise be associated with wrapping into and unwrapping from laterally adjacent grooves on the control wheel.

Figure 3:
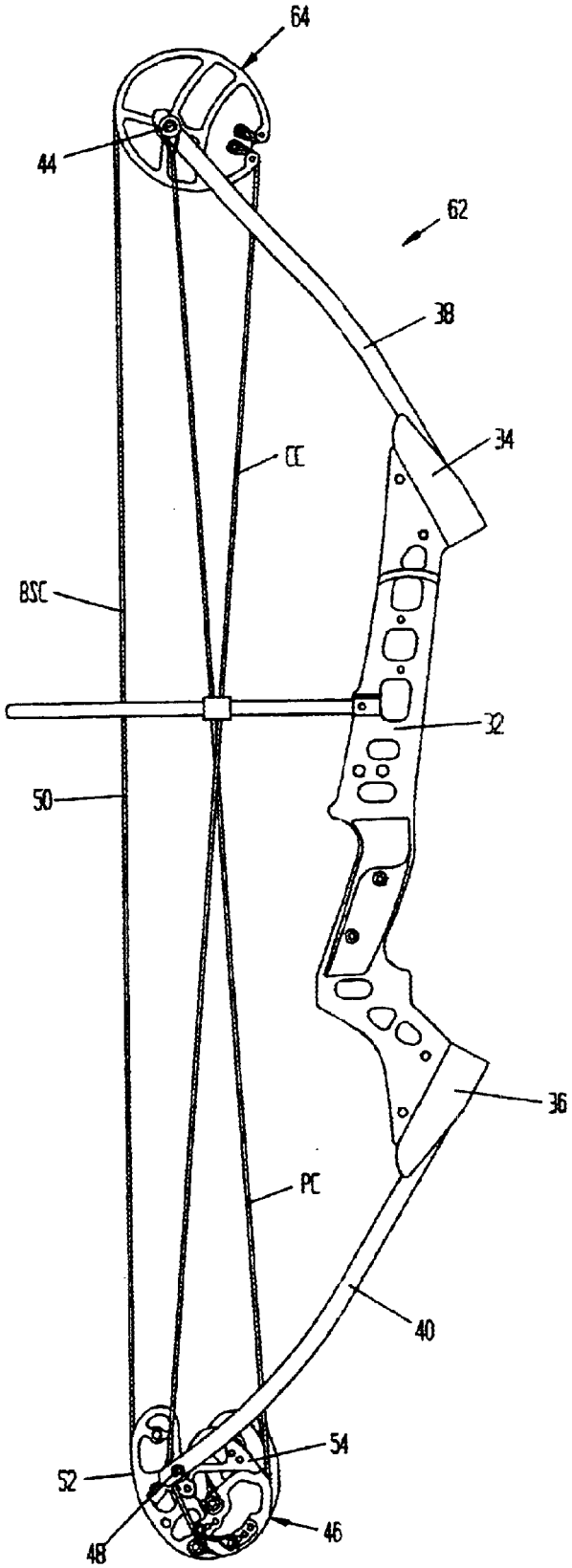
FIG. 3 is a side elevational view of a single-cam compound archery bow similar to that of FIG. 1 but having a different control wheel.
Figure 4:
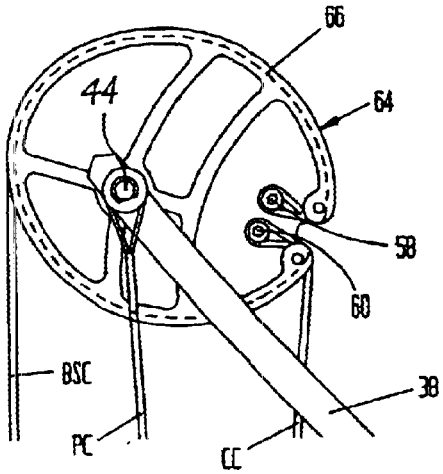
FIG. 4 is a fragmentary elevational view similar to that of FIG. 2 but illustrating the modified control wheel of FIG. 3.

FIGS. 3 and 4 illustrate a single-cam bow 62 that is similar to that of FIGS. 1 and 2, but which features a modified control wheel 64. Elements in FIGS. 3 and 4 (and FIGS. 5–12) that are identical to those in the embodiment of FIGS. 1 and 2 are indicated by correspondingly identical reference numerals. Control wheel 64 has a single non-circular peripheral groove 66 that is offset from the axis of axle 44 and lies in a plane perpendicular to such axis. Both bowstring cable BSC and control cable CC are anchored to control wheel 64 to travel in groove 66. Bowstring cable BSC is let out of groove 66 as the bow is drawn, and control cable CC is taken up in the same groove. At some point, the control cable may enter a segment of the groove that was previously occupied by the bowstring cable in the rest position of the bow. This embodiment provides greater control of bowstring let-out, while simultaneously maintaining control of nock travel and making it easier to achieve more stored energy in the bow.

Figure 5:
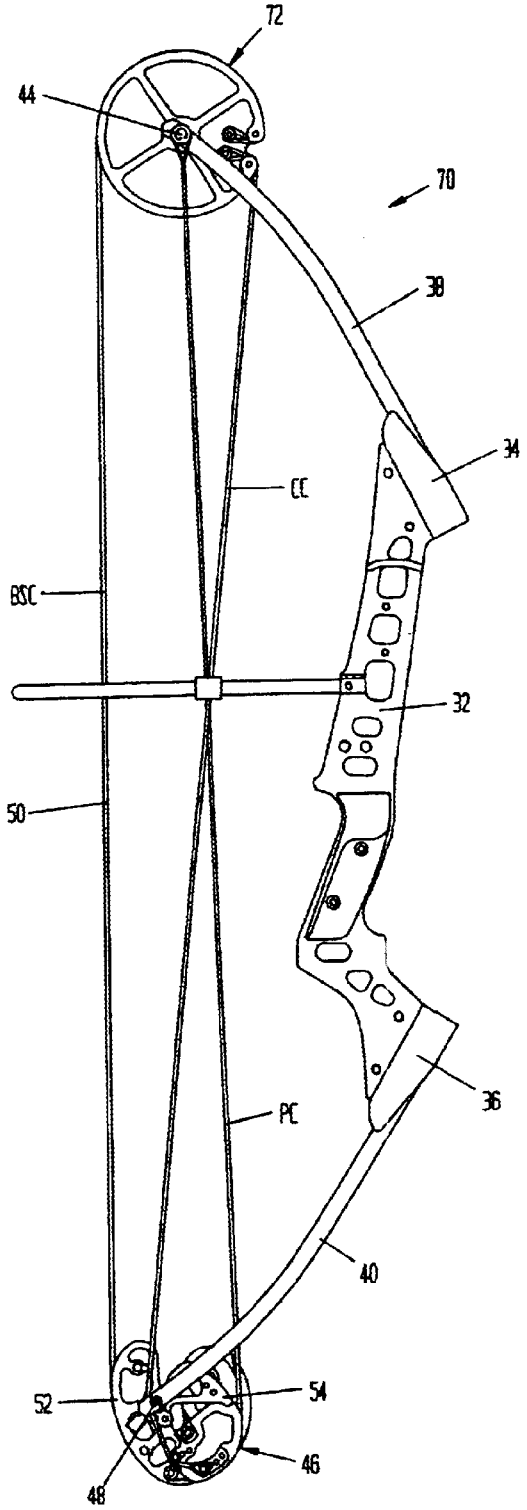
FIG. 5 is a side elevational view of a single-cam bow that is similar to those of FIGS. 1 and 3 but having a modified control wheel or idler.
Figure 6:
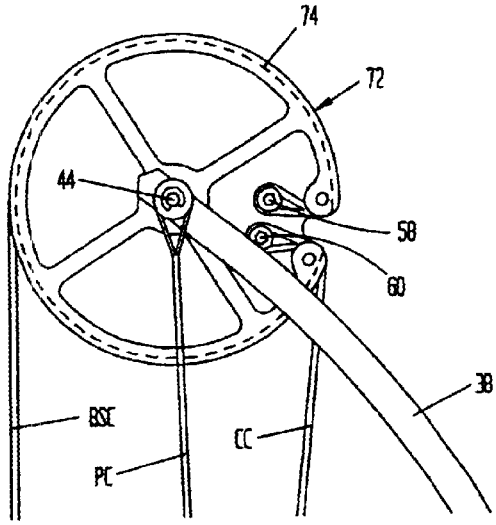
FIG. 6 is a fragmentary enlarged view of the control wheel in the bow of FIG. 5.

FIGS. 5 and 6 illustrate a single cam bow 70 having a concentric single-groove control wheel or idler 72. That is, idler 72 has a circular peripheral groove 74 that is concentric with axle 44 and lies in a plane perpendicular to the axis of rotation. Again, there is a gap in the wheel rim for cables BSC, CC to anchor to posts 58, 60.

Figure 7:
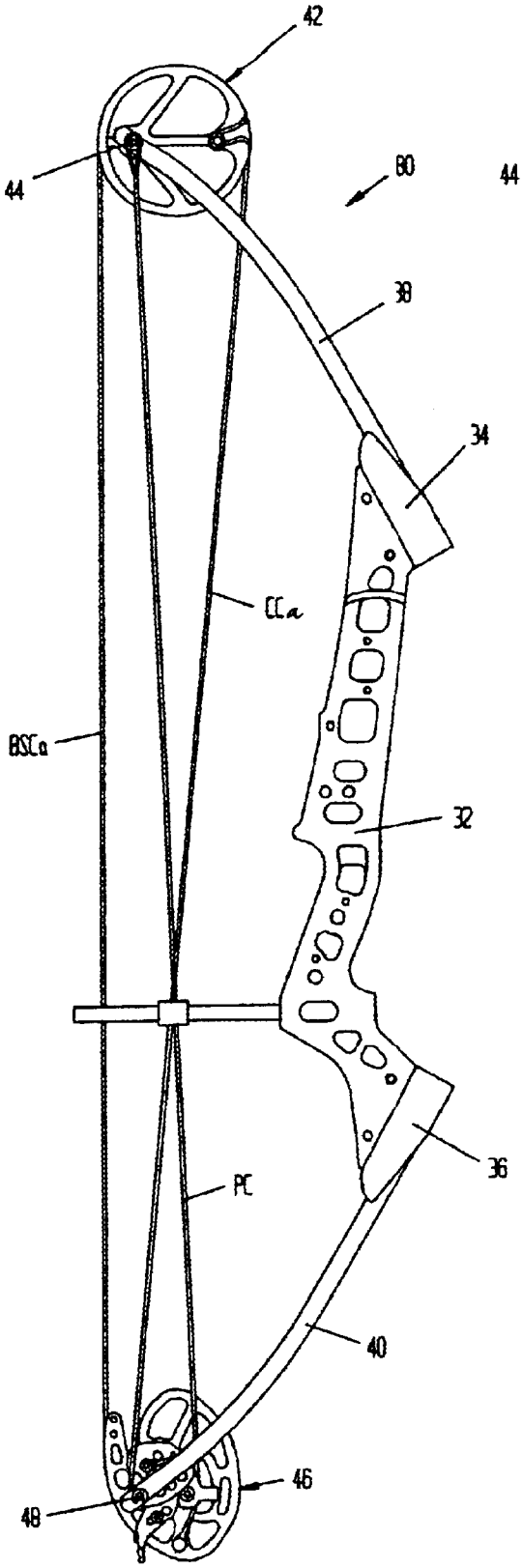
FIG. 7 is a side elevational view of a single-cam compound archery bow in accordance with another embodiment of the invention.
Figure 8:
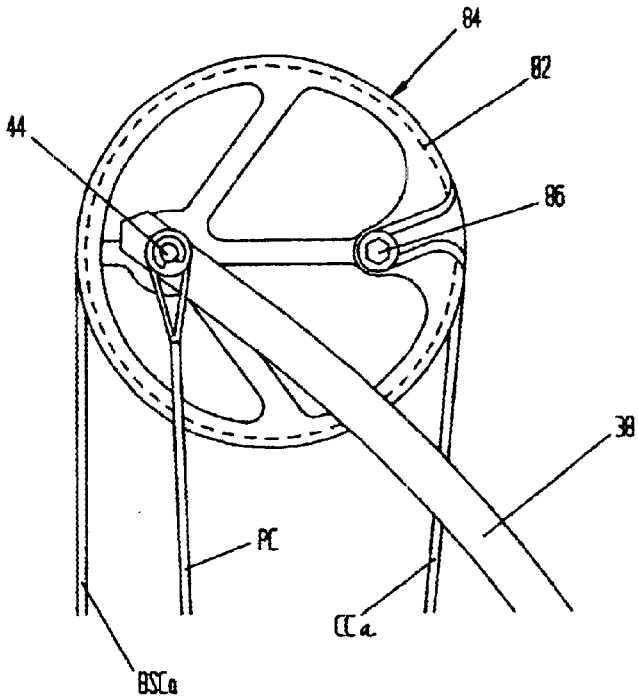
FIG. 8 is a fragmentary enlarged view of the control wheel in the bow of FIG. 7.
Figure 9:
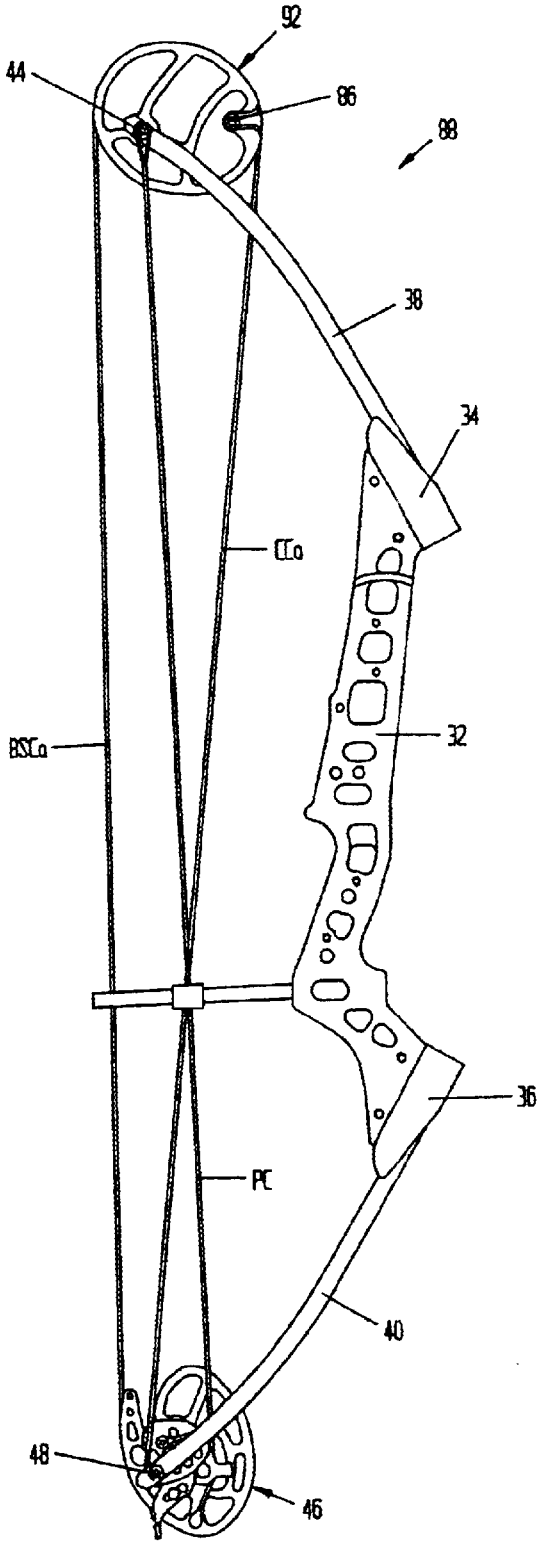
FIG. 9 is a side elevational view of a single-cam compound archery bow in accordance with a further embodiment of the invention.
Figure 10:
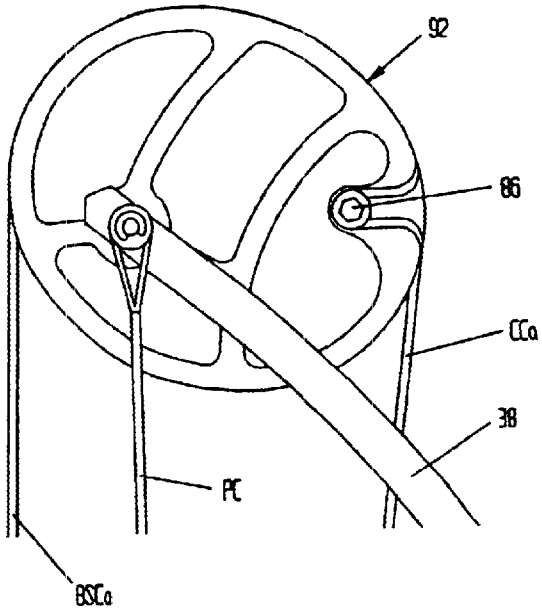
FIG. 10 is a fragmentary enlarged view of the control wheel in the bow of FIG. 9.
Figure 11:
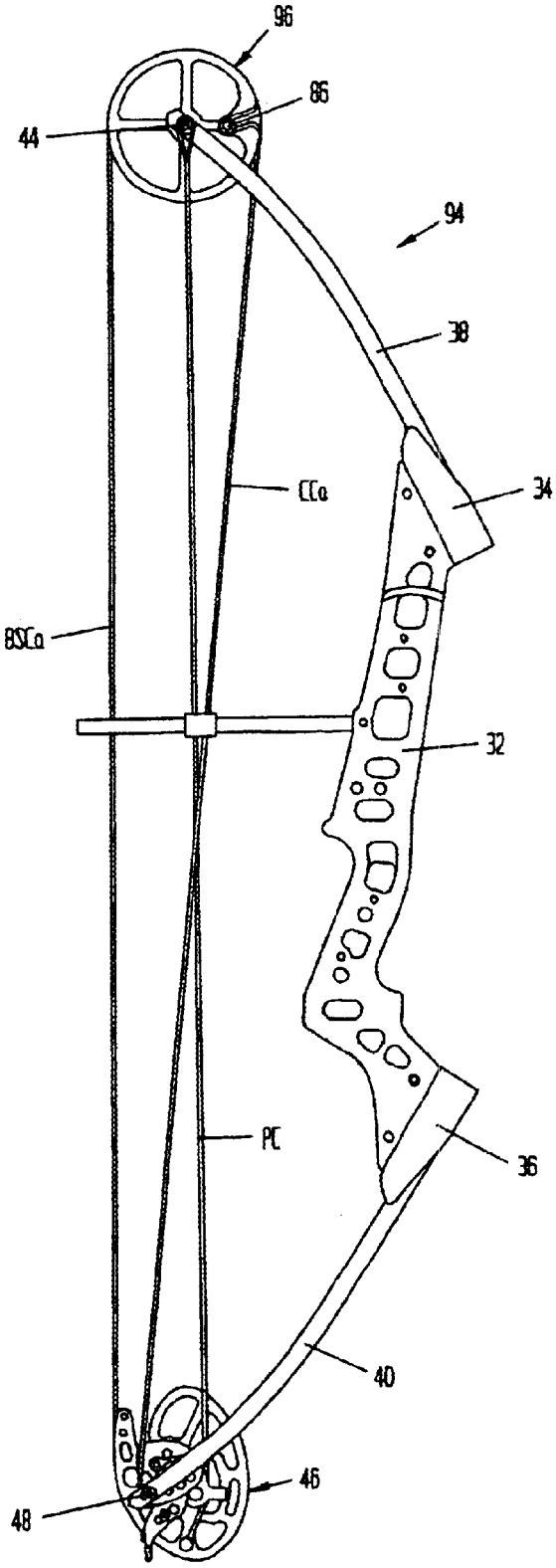
FIG. 11 is a side elevational view of a single-cam compound archery bow in accordance with yet another embodiment of the invention.
Figure 12:
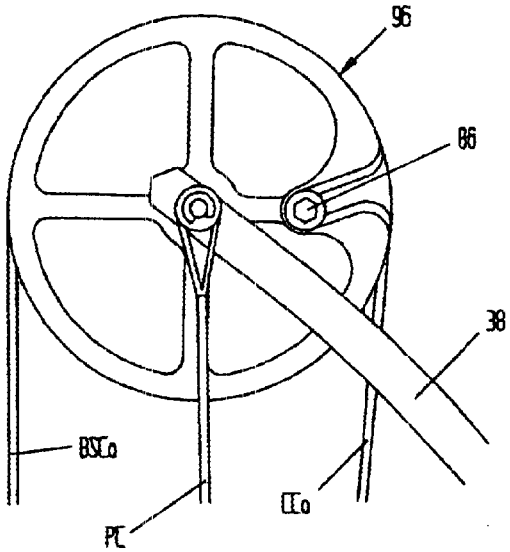
FIG. 12 is a fragmentary enlarged view of the control wheel in the bow of FIG.

FIGS. 7 and 8 illustrate a single-cam compound archery bow 80 that is similar to bow 30 in FIGS. 1 and 2, except that bowstring cable BSCa and control cable CCa comprise a continuous length of cable that is wrapped around a groove 82 in the control wheel 84. The continuous length of cable is anchored at 86 to control wheel 84 radially inwardly of the gap in control wheel groove 82. Thus, anchor 86 not only anchors the continuous length of cable to the control wheel, but also effectively divides the continuous length of cable into separate control cable and bowstring cable segments CCa and BSCa. FIGS. 9 and 10 illustrate a compound archery bow 88 that is similar to that of FIGS. 3 and 4, but in which a single anchor 86 at control wheel 92 anchors and effectively divides a continuous length of bow cable into separate control cable and bowstring cable segments CCa and BSCa. Likewise, FIG. 11 and illustrate a compound archery bow 94 that is similar to that of FIGS. 5 and 6, but in which a single anchor 86 at the control wheel 96 effectively divides a continuous length of bow cable into separate control cable and bowstring cable segments CCa and BSCa. Other means of providing a single anchor at the control wheel can also be employed.

There have thus been disclosed a number of single-cam compound archery bows and bow control wheels that provide improved control of nock point travel, improved control of bowstring cable let-out, that reduced bending or twisting forces on the control wheel axle, and in which improved stored energy is easier to achieve. In all of the disclosed embodiments, the control wheel has a single peripheral groove that lies in a plane perpendicular to the axis of rotation of the control wheel. In each embodiment, control cable CC or CCa is wrapped into the groove as bowstring cable BSC or BSCa is unwrapped from the groove as the bow is drawn. The diameter of the control wheel must be sufficient to allow the bowstring cable to unwrap from the control wheel and the control cable to wrap onto the control wheel without interfering with each other as the bowstring is drawn. When the bow is released, the opposite action takes place. The non-concentric control wheel groove arrangements of FIGS. 1–4 and 7–10 are particularly preferred in that these control wheel configurations help improve timing of the control wheel with respect to the grooves in the power cam, and thus help improve straight-line nock point travel. In all embodiments, the control wheel preferably comprises a single body, of cast aluminum for example, to which the axle, axle mounting bearings (if any) and anchor(s) are assembled.

What is claimed is:

1. A single-cam compound archery bow that comprises:

a bow handle having projecting limbs, a control wheel mounted for rotation about an axis at an end of one of said limbs, said control wheel having a single peripheral groove around said axis, a power cam mounted for rotation at an end of the other of said limbs, bow cable means including a first cable segment anchored at one end to said one limb and at a second end to said power cam, a second cable segment anchored to said control wheel and extending to said power cam, and a third cable segment anchored to said control wheel and extending to said power cam, said third cable segment having a nock point that, when drawn away from said handle, unwraps said third cable segment from said control wheel groove and wraps said second cable segment into said control wheel groove as said third cable segment is unwrapped from said groove, and wraps said first cable segment onto said power cam so as to draw said limbs together.

2. The bow set forth in claim 1 wherein said single peripheral groove lies in a plane perpendicular to said axis.

3. The bow set forth in claim 2 wherein said second and third cable segments comprise separate cable segments, each anchored at said control wheel.

4. The bow set forth in claim 2 wherein said second and third cable segments comprise a continuous cable segment anchored at said control wheel between ends of said continuous cable segment.

5. The bow set forth in claim 2 wherein said peripheral groove on said control wheel is circular.

6. The bow set forth in claim 5 wherein said circular peripheral groove is concentric with said axis.

7. The bow set forth in claim 5 wherein said circular peripheral groove is non-concentric with said axis.

8. The bow set forth in claim 2 wherein said single peripheral groove is non-circular.

9. A single-cam compound archery bow that comprises:

a bow handle having projecting limbs, a control wheel mounted on an end of one of said limbs for rotation about an axis of rotation, said control wheel having a peripheral control wheel groove in a plane perpendicular to said axis, a power cam rotatably mounted on an end of the other of said limbs, said power cam including a bow string groove and a power cable groove, and bow cable means including a power cable segment anchored at a second end to said power cam at a position to wrap into and unwrap from said power cable groove, a bowstring cable segment anchored at said control wheel at a position to wrap into and unwrap from said control wheel groove and at said power cam at a position to wrap into and unwrap from said bowstring groove, and a control cable segment anchored at said control wheel at a position to wrap into and unwrap from said control wheel groove and anchored at said power cam, such that draw of said bowstring cable segment away from said handle unwraps said bow string cable segment from said bowstring groove and said control wheel groove, wraps said control cable segment into said control wheel groove as said bowstring cable segment is unwrapped from said control wheel groove, and wraps said power cable segment into said power cable groove so as to draw said limbs together.

10. The bow set forth in claim 9 wherein said bowstring and control cable segments comprise separate cable segments, each anchored at said control wheel.

11. The bow set forth in claim 9 wherein said bowstring and control cable segments comprise a continuous cable segment anchored at said control wheel between ends of said continuous cable segment.

12. The bow set forth in claim 9 wherein said peripheral groove at said control wheel is circular.

13. The bow set forth in claim 12 wherein said circular peripheral groove is concentric with said axis.

14. The bow set forth in claim 12 wherein said circular peripheral groove is non-concentric with said axis.

15. The bow set forth in claim 9 wherein said peripheral groove at said control wheel is non-circular.

16. A single-cam compound archery bow that comprises:

a bow handle having projecting limbs, a control wheel mounted for rotation about an axis at an end of one of said limbs, said control wheel having a single peripheral groove surrounding and non-concentric with said axis, said groove lying in a plane perpendicular to said axis and having a gap, and first and second anchors on said control wheel disposed radially inwardly of said gap, a power cam mounted for rotation at an end of the other of said limbs, bow cable means including a first cable segment anchored at one end to said one limb and at a second end to said power cam, a second cable segment anchored to said control wheel at one of said anchors and extending to said power cam, and a third cable segment anchored to said control wheel at the other of said anchors and extending to said power cam, said third cable segment having a nock point that, when drawn away from said handle, unwraps said third cable segment from said control wheel groove and wraps said second cable segment into said control wheel groove as said third cable segment is unwrapped from said groove, and wraps said first cable segment onto said power cam so as to draw said limbs together.

17. The bow set forth in claim 16 wherein said peripheral groove on said control wheel is circular.

18. The bow set forth in claim 16 wherein said circular peripheral groove on said control wheel is non-circular.

19. A control wheel for a single-cam compound archery bow, which comprises:

a body having means for mounting said body on a bow limb to rotate about an axis, and a single non-circular peripheral groove surrounding said axis and lying in a plane perpendicular to said axis, said single peripheral groove including a gap, and means positioned radially inwardly of said gap for anchoring bow cable segments to wrap into and unwrap from portions of said groove on opposite sides of said gap.

20. The control wheel set forth in claim 19 wherein said anchoring means comprises first and separate anchors for anchoring separate bow cable segments.

21. The control wheel set forth in claim 19 wherein said anchor means comprises a single anchor for anchoring a continuous bow cable segment.

* * * * *